US006851789B2

(12) United States Patent
Cano et al.

(10) Patent No.: US 6,851,789 B2
(45) Date of Patent: Feb. 8, 2005

(54) POSITION MEASUREMENT SYSTEM AND METHOD

(75) Inventors: Emilio Cano, Barcelona (ES); Juan Perez, Sevilla (ES); Jose Miguel Toran, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 49 days.

(21) Appl. No.: 10/424,809

(22) Filed: Apr. 29, 2003

(65) Prior Publication Data

US 2004/0218004 A1 Nov. 4, 2004

(51) Int. Cl.[7] ..... B41J 23/00
(52) U.S. Cl. ..... 347/37
(58) Field of Search ..... 347/37, 5, 14, 347/20, 23, 39, 43; 400/74, 283, 320.1, 355–357, 663

(56) References Cited

U.S. PATENT DOCUMENTS

| | | | | |
|---|---|---|---|---|
| 4,683,481 | A | 7/1987 | Johnson | |
| 5,278,584 | A | 1/1994 | Keefe et al. | |
| 6,267,466 | B1 * | 7/2001 | Gudaitis et al. | 347/37 |
| 6,302,506 | B1 * | 10/2001 | Norton | 347/14 |
| 6,783,209 | B2 * | 8/2004 | Gompertz | 347/43 |

* cited by examiner

*Primary Examiner*—K. Feggins
(74) *Attorney, Agent, or Firm*—Foley & Lardner LLP

(57) ABSTRACT

A hardcopy device having a scanning head arranged to reciprocate across a scan axis, and first and second codestrips arranged substantially parallel to the scan axis, the first and second codestrips being offset from one another in the scan axis, such that the device may determine the position of the head along the scan axis relative to the first and second codestrips in a first set of positions but relative to only one of the first and second codestrips in a second set of positions.

22 Claims, 3 Drawing Sheets

POSITION MEASUREMENT SYSTEM AND METHOD

FIELD OF THE INVENTION

The present invention relates generally to a position measurement system, particularly, although not exclusively, to a method and apparatus for determining the position of scanning printer carriages in inkjet printer devices.

BACKGROUND OF THE INVENTION

Inkjet printer devices generally incorporate one or more inkjet cartridges, often called "pens", which shoot drops of ink onto a page or sheet of print media. For instance, two earlier thermal ink ejection mechanisms are shown in U.S. Pat.

Nos. 5,278,584 and 4,683,481, both assigned to the present assignee, Hewlett-Packard Company. The pens are usually mounted on a carriage, which is arranged to scan across a slider rod that traverses a print zone, in which a sheet of print media may be located. As the carriage traverses the print zone, the pens print a series of individual drops of ink on the print media forming a band or "swath" of an image, such as a picture, chart or text. The print media is subsequently moved relative to the carriage, so that a further swath may be printed adjacent to the earlier swath. By a repetition of this process, a complete printed page may be produced in an incremental manner.

In order to generate high quality printed output, it is necessary that the ink drops from the individual pens are accurately applied to the print media. This is made possible by accurately measuring the position of the carriage as it traverses the print media. This is generally achieved using an encoder strip or codestrip, which is arranged parallel to the scan direction of the carriage. Such a codestrip is usually made from a plastics material such as Mylar™, upon which a series of graduations or marks are recorded. The graduations, which may be recorded using a laser plotter, give rise to local variations in the properties (such as optical properties) of the codestrip. An optical sensor mounted on the carriage may be used to sense the optical variations in the codestrip as the carriage moves relative to it. The output of the sensor may be used by a microprocessor associated with the printer device to generate position and speed information relating to the carriage.

Currently, the length of such codestrips is limited by the high cost of the machinery required to make manufacture them. However, as demand requires scanning printers with increasingly wide scan axes, longer codestrips are required. Due to the high resolution of the graduations recorded on a codestrip, it is not generally practicable to join two codestrips end-to-end to increase their usable length without causing substantial positioning errors in the region of the join. This is because it is generally not practicable to ensure that the last graduation of one codestrip is separated from the first graduation of the next codestrip by the correct distance.

This distance, if too great, may cause a gross positioning error in the region of a gap between the two codestrips, where no graduations are present. Furthermore, whether the distance is too great or too small, the signals generated by a sensor when reading one codestrip may be phase shifted relative to the signals generated when reading the next codestrip. Of course, both of these factors will cause carriage position measurement errors.

It would therefore be desirable to provide a hard copy device and method, which addresses the problems of the prior art.

SUMMARY OF THE INVENTION

According to a first aspect of the present invention there is provided a hardcopy device having a scanning head arranged to reciprocate across a scan axis, and first and second codestrips arranged substantially parallel to the scan axis, the first and second codestrips being offset from one another in the scan axis, such that the device may determine the position of the head along the scan axis relative to the first and second codestrips in a first set of positions but relative to only one of the first and second codestrips in a second set of positions.

Advantageously, this allows a hardcopy apparatus according to embodiments of the invention, such as inkjet printers, to have a scanning axis that is longer than the length of a commercially available codestrip. In one embodiment of the invention, two codestrips of conventional length are used in order to provide carriage position and speed information. In this embodiment, each of the codestrips extends the entire way across the print zone of an inkjet printer as well as across a different one of the two acceleration/deceleration zones located on either side of the print zone. In this manner, an entire printing pass may be made in either direction, across an acceleration zone and then over the print zone, without incurring any position errors that might occur if two codestrips were joined, for example. It will be appreciated that the maximum achievable width of scan axis of embodiments of the invention may thus be increased without sacrificing the accuracy with which the print carriage may be determined when in the print zone.

In further embodiments of the invention, while the scanning head, such as a printhead of a hardcopy device, is located in its working area in the scan axis, for example the print zone, position information is obtained from first and second codestrips. In this manner, errors that might otherwise arise in the measurement of the position of the head in the scan axis, due to rotation of the head may be compensated for. Such rotation may be about the vertical axis of the head, for example. In one embodiment, this is achieved by generating a weighted average of the position information derived from the first and second codestrips.

The present invention also extends to the method corresponding to the apparatus.

Furthermore, the present invention also extends to each of a computer program and a processor device, arranged to implement the method of the present invention. Further aspects of the invention will be apparent from the appended claims.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which.

DETAILED DESCRIPTION OF THE INVENTION

There will now be described by way of example only the best mode contemplated by the inventors for carrying out the invention.

FIRST EMBODIMENT

Figure 1A:
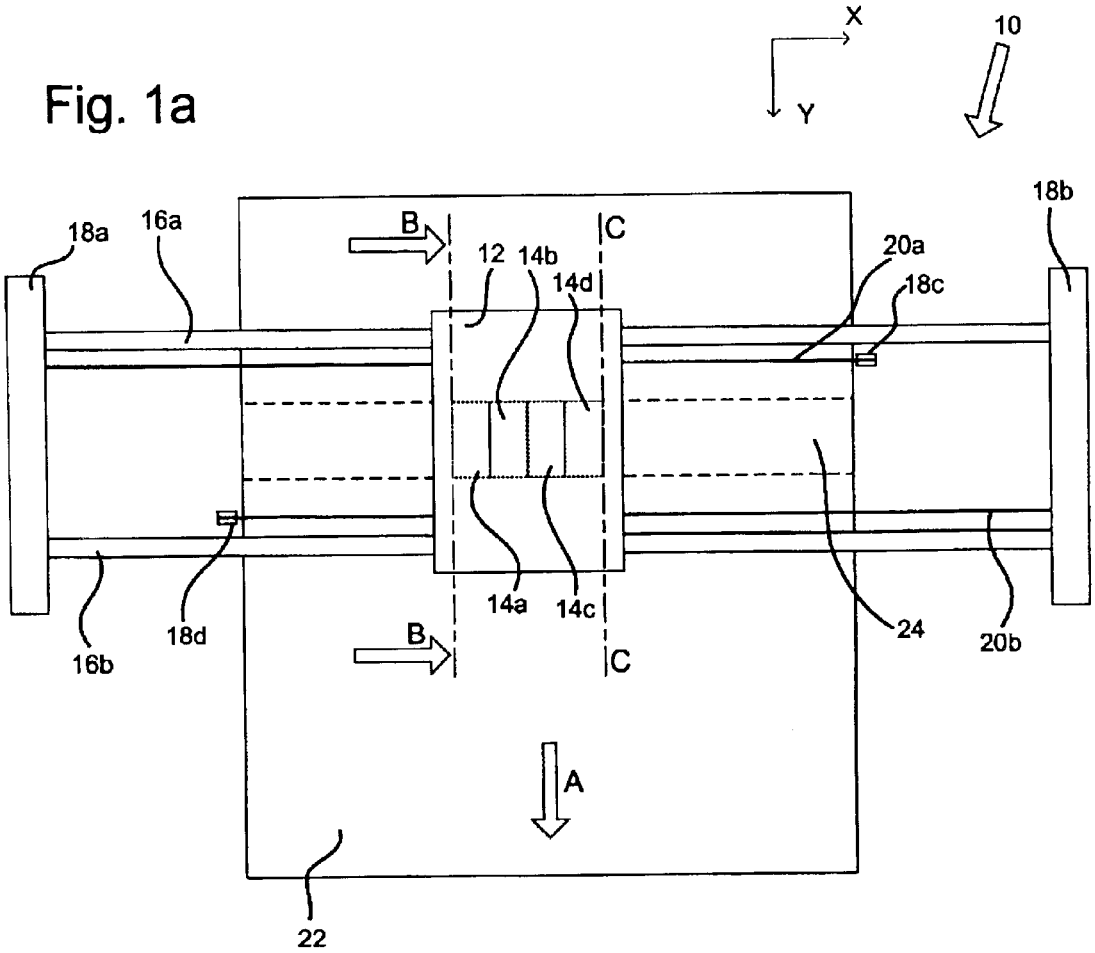
FIG. 1*a* shows a schematic plan view of a large format inkjet printer according to one embodiment of the present invention.

FIG. 1*a* schematically illustrates an inkjet printing mechanism according to a first embodiment of the invention in plan view. In the present example, the ink-jet printing mechanism is large format inkjet printer 10, which is suitable for printing conventional engineering and architectural drawings, as well as high quality poster-sized images.

As can be seen from the figure, the printer 10 has a chassis, here represented by two parallel plates 18*a* and 18*b*. Two carriage guide rods 16*a* and 16*b* are supported between the plates 18*a* and 18*b*. The two guide rods 16*a* and 16*b* lie parallel to one another and are aligned with the scanning axis of the printer. This lies parallel to the X axis shown in the figure. The two guide rods 16*a* and 16*b* are arranged to support an inkjet carriage 12. The carriage 12 is arranged to be driven back and forth in a conventional manner along the scanning axis, between the plates 18*a* and 18*b* and in so doing to traverse the print zone 24 of the printer. In the present embodiment, this is achieved using a conventional carriage drive motor (not shown) that propels the carriage 12 in either direction along the guide rods 16*a* and 16*b* in response to control signals received from a conventional printer controller 32, schematically illustrated in FIG. 1*b*.

Figure 1B:
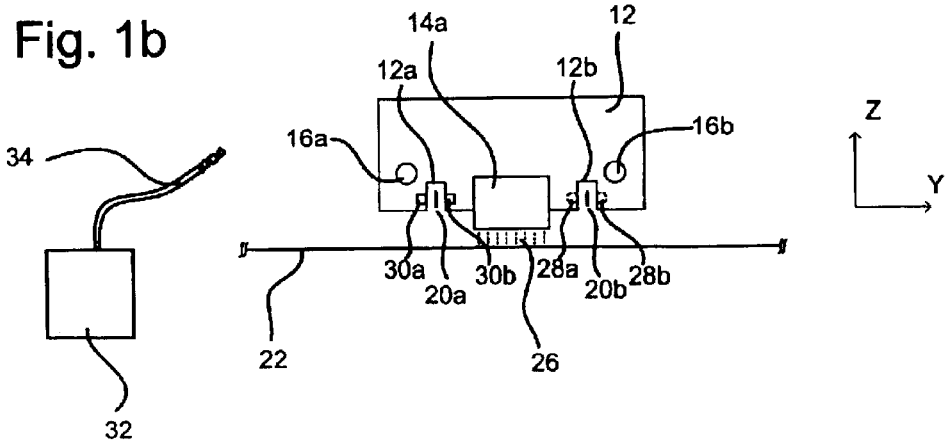
FIG. 1*b* illustrates a cross sectional view of the carriage assembly shown in FIG. 1*a;*

The controller 32 may be a suitably programmed general purpose microprocessor or an ASIC and is arranged to communicate with the various subsystems of the printer 10 and other devices, such as a host device, via one or more conventional communications channels 34; which is also schematically illustrated in FIG. 1*b*.

The printer 10 also includes a conventional print media handling system (not shown) to advance a sheet of print media 22 through the print zone 24. The print media 22 may be any type of suitable material, such as paper, poster board, fabric, transparencies and the like, either in pre-cut sheet form or held in the form of a roll. In FIG. 1*a*, the print media 22 illustrated is the widest suitable for use in the printer of the present embodiment. Thus, the left and right hand edges of the print media 22 correspond to the left and right hand edges, respectively, of the print zone 24.

In this manner, the controller may control the carriage position in the X axis and the position of the print media in the Y axis such that the inkjet pen supported by the carriage 12 may print at the desired locations on the printing area of the print medium.

Four inkjet printheads 14*a–d* are located in the carriage. Each printhead has an orifice plate with a plurality of nozzles formed therethrough in a manner well known to those skilled in the art. As can be seen from FIG. 1*b*, each printhead is arranged to print drops of ink 26 in a band or swath on the print medium 22 located in the print zone 24. In the present embodiment, the printheads are thermal ink-jet printheads, although other types of printheads may be used, such as piezoelectric printheads. In the present embodiment, the printheads 14*a–d* are arranged to print: cyan; magenta; yellow; and black ink, respectively. However, it will be appreciated that in other embodiments of the invention, other numbers of printheads may be employed, which may be arranged to print a greater or smaller number of colours of ink.

In the present embodiment, a conventional "off-axis" ink delivery system is used.

By this, it is meant that main stationary reservoirs (not shown) for each ink colour are located in an ink supply region (not shown). Thus, the printheads 14*a–d* may be replenished by ink conveyed through a conventional flexible tubing system (not shown) from the stationary main reservoirs. In this manner, only a small ink supply is propelled by carriage 12 across the print zone 24. It will be appreciated however, that in other embodiments of the invention, an "on-axis" ink delivery system may instead be used.

The printer 10 also includes two codestrips 20*a* and 20*b* mounted using conventional codestrip mounting techniques such that they are aligned parallel with the scanning axis of the printer.

The codestrip 20*a* is supported between the plate 18*a* and a conventional codestrip mounting stanchion 18*c*. As can be seen from FIG. 1*a*, the plate 18*a* is spaced apart from the print zone 24; to the left of the print zone as illustrated in the figure. Although not shown to scale in the figure, this space between the print zone and the plate 18*a* provides a portion of the scan axis in which the printer carriage may decelerate from printing speed to zero velocity having completed a pass in the right to left direction as viewed in FIG. 1*a*. Additionally, the printer carriage may accelerate from zero velocity to printing speed in this portion of the scan axis prior to entering the print zone when about to make a pass over the print zone in the left to right direction as viewed in FIG. 1*a*. Furthermore, this space may be used to store the printer carriage during periods of inactivity or to implement conventional servicing activities on the printheads. This may be implemented using conventional printhead service station equipment (not shown). Such servicing activities are well known in the art and so will not be described further herein. Thus, this deceleration/acceleration zone may also be termed a servicing zone.

The mounting stanchion 18*c* is also located space apart from the print zone; to the right of the print zone as illustrated in the figure. However, in the present embodiment, the mounting stanchion 18*c* is located dose to the edge of the print zone. Thus, the codestrip 20*a* extends all of the way across the print zone of the printer and the deceleration/acceleration zone to the left of the print zone.

As can be seen from FIG. 1*a*, the codestrip 20*b* is supported between the plate 18*b* and further conventional codestrip mounting stanchion 18*d*. In the present embodiment, the codestrip 20*b* is the same length as codestrip 20*a* and mounted in the same way as described with reference to codestrip 20*a*. Thus, the codestrip 20*b* extends all of the way across the print zone of the printer and across a deceleration/acceleration zone to the right of the print zone, as viewed in the figure. In the present embodiment, the deceleration/acceleration zone to the right of the print zone, as viewed in the figure, may be used to store the off axis ink supplies employed in the present embodiment and other equipment associated with a conventional ink dispensing system (not shown).

The width of both of the deceleration/acceleration zones in the present embodiment may vary. However, as will be understood from the following description, for a given length of codestrip 20*a* and 20*b*, the width of the print zone may be increased by using deceleration/acceleration zones having a width, which is no more than that required to fulfil its functions.

The position of the stanchions 18*c* and 18*d* relative to the print zone may also vary in the present embodiment Again, however, as will be understood from the following description, for a given length of codestrip 20*a* and 20*b*, the width of the print zone may be increased by ensuring that the end of each codestrip which is mounted on the stanchion does not extend unnecessarily beyond the print zone.

In this manner, it will be appreciated that in the present embodiment the codestrips 20*a* and 20*b* are offset from each other in the scan axis direction. Although both of the codestrips 20*a* and 20*b* extend across the print zone of the printer, each codestrip extends a substantial distance outside of the print zone on one side only of the print zone, that being a different side from the other codestrip. Thus, only one codestrip extends over each deceleration/acceleration zone.

Any suitable commercially available codestrips may be used in the present embodiment. Such codestrips are available from PWB-Ruhlatec, Industrial Products GmbH, Siegburger Str. 39c, D53757 St. Augustin, Germany. In the present embodiment, the codestrips 20*a* and 20*b* have a series of graduations formed on them, arranged perpendicular to the length of the codestrip. Typically, the codestrips are manufactured from a plastics material such as Mylar™ and are formed using a laser plotter by writing equi-spaced, optically readable graduations on the codestrip.

It will be understood that although each codestrip in this embodiment is mounted between a stanchion and a plate, in other embodiments this may be varied. For example, a further known suitable codestrip mounting technique is to fix a reinforcing metal strip to the codestrip. This may be using an adhesive for example. The strip may then be mounted between the two plates 18*a* and 18*b*. It will be appreciated that such a strip may be manufactured longer than the codestrip in order to span the distance between the plates 18*a* and 18*b*.

Referring now to FIG. 1*b*, this figure illustrates a cross sectional view of the carriage assembly 12, the guide rods 16*a* and 16*b* and the codestrips 20*a* and 20*b*, taken along the line B—B, as shown in FIG. 1*a*.

As can be seen from the figure, the carriage 12 incorporates two recesses (not referenced) with high precision bearings allowing the guide rods 16*a* and 16*b* to pass through the carriage 12 in a high tolerance sliding fit; in this manner allowing the carriage to be accurately located with respect to the guide rods 16*a* and 16*b* as it moves along the scan axis. The carriage 12 also incorporates two further recesses 12*a* and 12*b*. The recesses 12*a* and 12*b* are both schematically illustrated as being located on the lower surface of the carriage as illustrated in the figure and being open to the lower surface of the carriage. The size and position of the recesses 12*a* and 12*b* and the two codestrips 20*a* and 20*b* are selected such that each codestrip passes freely through a corresponding recess as the carriage moves relative to the guide rods 16*a* and 16*b*.

Referring now to the recess 12*a*, a light source 30*a*, which is typically an LED, is located in one wall of the recess 12*a*. Located in the opposing wall of the recess 12 is a light receiving sensor 30*b*, such as an LDR. The light source 30*a* emits light toward the sensor 30*b*. However, due to relative positions of the light source 30*a*, the sensor 30*b* and the codestrip 20*a*, the light must pass through the codestrip 20*a* (when it located between the light source 30*a* and the sensor 30*b*) in order to be received by the sensor 30*b*. As the carriage moves relative to the stationary codestrip 20*a*, the alternating transparent and opaque regions (graduations) of the codestrip 20*a* cause the light emitted by the light source 30*a* to be alternately sensed and not sensed by the sensor 30*b*. The sensor 30*b* responds to the resulting variations in received light by outputting a correspondingly varying electrical signal. Any suitable sensor system may be used in the present embodiment. One suitable sensor, which combines emitter and received is the HEDS9100 sensor, available from Hewlett Packard Company.

As can be seen from the figure, the recess 12*b* also has associated with it an optical sensor system arranged read the codestrip 20*b* and to output carriage position signals that may be utilised to determine the position of the carriage 12 along the scan axis. The sensor system associated with the recess 12*b* includes a light source 28*a* and a sensor 28*b*, which may be the same as, and operate in the same manner as the light source 30*a* the sensor 30*b*, and so will not be additionally described. The light source 28*a* and a sensor 28*b* are shown in dotted line in the figure since they lie on the axis C—C, illustrated in FIG. 1*a*. It can be seen from FIG. 1*a*, that the light source 30*a* and the sensor 30*b* lie adjacent the extreme left hand end of the printhead 14*a*, as viewed in the figure. Similarly, the light source 28*a* and a sensor 28*b* lie adjacent the extreme right hand end of the printhead 14*d*, as viewed in the figure.

Figure 2A:
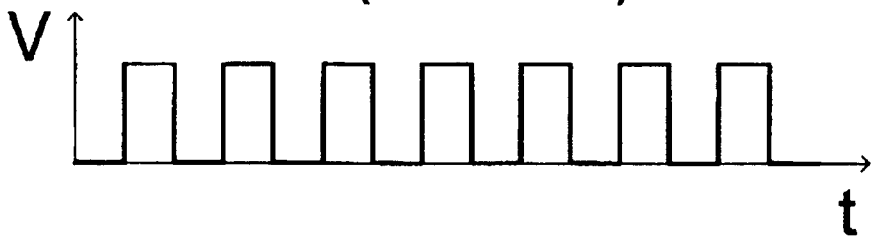
Fig. 2a (Prior Art)
FIG. 2*a* schematically illustrates a conventional carriage position signal.

As is well understood in the art, each sensor system outputs a signal whilst reading the corresponding codestrip, which from hereon will be referred to as a carriage position signal, which may be used by a printer controller in order to determine the position of the carriage. This may be in the form of a square wave as is schematically illustrated in FIG. 2*a*. In this figure, the high output values, or "ones", correspond to the output of the sensor 28*b* or 30*b* when receiving light emitted by the corresponding light source 28*a* or 30*a*. The low output values, or "zeros", correspond to the output of the sensor 28*b* or 30*b* when the light emitted by the corresponding light source 28*a* or 30*a* is blocked by the opaque parts of the measured codestrip. Commonly, printer carriage position measurement systems employ codestrips having 150 graduations per inch. Thus, the distance between two adjacent rising edge in the signal corresponds to 1/150 inch of travel along the measured codestrip. Thus, the distance between adjacent rising and falling edges in the output signal corresponds to 1/300 inch. As is discussed below, certain techniques are known for further increasing the resolution of measurement of codestrips having a given number of graduations per inch. It will be understood that such techniques may be employed with benefit in this or other embodiments of the invention, however, for the sake of clarity, such techniques will not be described here.

In the present embodiment, the printer controller controls the carriage drive motor to drive the carriage across the scan axis in order to print a swath. This is carried out in a convention manner. This may initially be from left to right as viewed in FIG. 1*a*; hereafter termed the first direction.

As the carriage accelerates in the acceleration/deceleration zone, the controller determines the speed and position of the carriage from position information determined by reading the codestrip 20*a* with sensor 30*b*. It will be appreciated that during this acceleration phase, there is no codestrip located between the light source 28*a* and the sensor 28*b*.

As the printer carriage passes into the print zone, the light source 28*a* and the sensor 28*b* pass over the stanchion 18*d* and are then located on either side of codestrip 20*b*. It will be understood that in the present embodiment, the stanchions 18*c* and 18*d* are arranged not to interfere with the lower surface of the carriage, for example the codestrip sensor systems, as the carriage passes over them.

In this embodiment, whilst the carriage is moving across the print zone in the first direction, the controller reads codestrip 20*a* only. Using position and speed information derived from reading codestrip 20*a* the printer controller controls the printheads to print normally the entire way across the print zone. Thus, as the carriage passes across the print zone, the controller may continually determine the position of the carriage relative to its starting position at the left hand end of the scan axis, as viewed in FIG. 1*a*. It will be appreciated that this may be so without any discontinuity in the codestrip that could cause a position measurement error.

When the last printhead (in this pass this is printhead 14*a*) passes out of the print zone and into the right hand acceleration/deceleration zone, the light source 30*a* and the sensor 30*b* move beyond the end of the codestrip 20*a*. It will be appreciated however that due to the positioning in the X axis of the light source 30*a* and the sensor 30*b* relative to the printheads, the codestrip 20*a* continues to be read until all of the printheads have passed out of the print zone.

At this point, the controller starts to read the other codestrip 20*b*. The incremental distance travelled by the carriage, as determined by reading the codestrip 20*b* is added to the last position recorded whilst reading the codestrip 20*a*.

It will be appreciated that this transition between codestrips may give rise to an is error or discontinuity in the calculated position of the carriage. Whilst such an error may be undesirable whilst printing, in the present embodiment this occurs whilst the printheads lie outside of the print zone; and therefore whilst the printer is not printing. Indeed, at this stage, the carriage is in the right hand acceleration/deceleration zone and decelerates to zero velocity. This may be at the extreme right hand end of the scan axis as viewed in FIG. 1*a* or at a position somewhat offset from the extreme right hand end. This position may be used as a datum position by the controller. In this case, the controller may accurately determine the position of the carriage relative to the codestrip 20*b*, if this is required prior to the carriage returning along the scan axis The controller then controls the carriage to move along the scan axis, in the right to left direction as viewed in FIG. 1*a*: hereafter termed the second direction. The process of determining the position of the carriage is similar to that described whilst the carriage was moving in the first direction. However, the order in which the codestrips are used to determine the position of the carriage is reversed.

That is to say, as the carriage accelerates in the right hand acceleration/deceleration zone, the controller determines the speed and position of the carriage from position information determined by reading the codestrip 20*b* with sensor 28*b*. It will be appreciated that during this acceleration phase, there is no codestrip present between the light source 30*a* and the sensor 30*b*.

Again, whilst the carriage passes over the print zone, the controller derives position and speed information from a single codestrip; in the second direction this is from codestrip 20*b*. Using this information, the printer controller may control the printheads to print normally the entire way across the print zone.

Again, when the last printhead (in this pass this is printhead 14*d*) exits the print zone and passes into the left hand acceleration/deceleration zone, the light source 28*a* and the sensor 28*b* move beyond the end of the codestrip 20*b*. At this point, the controller starts to read the other codestrip 20*a*, in the same manner as described above, in order to control the position and speed of the carriage in the acceleration/deceleration zone. Once again, it will be appreciated that due to the positioning in the X axis of the light source 28*a* and the sensor 28*b* relative to the printheads, the codestrip 20*b* continues to be read until all of the printheads have stopped printing in the print zone.

The carriage then decelerates to zero velocity at the extreme left hand end of the scan axis as viewed in FIG. 1*a*, or at a position somewhat offset from the extreme left hand end. This position may be used as a datum position by the controller. In this case, the controller may accurately determine the position of the carriage relative to the codestrip 20*a*, if this is required prior to the carriage returning along the scan axis.

By a repetition of the described process, the carriage may be repeatedly driven across the scan axis.

It will thus be appreciated that the present embodiment allows the use of a scan axis that is significantly longer than is conventional, whilst using two codestrips of conventional length in order to provide carriage position and speed information. Furthermore, since each of the codestrips in the present embodiment extends the entire way across the print zone and a different one of the two acceleration/deceleration zones, an entire printing pass may be made in either direction without incurring position errors in the scan axis.

It will be understood that the present embodiment may be used to print using bidirectional, or alternatively, unidirectional print modes. In a bidirectional print mode, ink may be printed on the print medium whilst the carriage in travelling in the first and the second direction. Generally, such modes are faster than uni directional print modes although the print quality is generally less good. Consequently, bidirectional printmodes are usually used for draft quality output. In a unidirectional print mode, ink may be printed on the print medium whilst the carriage in travelling in only one of the two directions, for example, the first direction, the return pass serving merely to return the carriage to the correct end of the scan axis for making another printing pass. Unidirectional printmodes are usually used for improved image quality.

In an alternative embodiment, the controller is arranged to read a first encoder strip whilst the carriage is accelerating in an acceleration/deceleration zone and then to change to reading the other encoder strip prior to, or on entry into the printzone. For example, when the carriage is moving in the first direction, the controller may initially read the codestrip 20*a*, whilst in the acceleration/deceleration zone. When the carriage arrives at the stanchion 18*d*, the controller may then start to read codestrip 20*b*. In this manner, the controller may determine the position of the carriage relative to the codestrip 20*b* until the carriage comes to a stop at the right hand acceleration/deceleration zone. This approach may have the advantage of allowing the system to more accurately identify the starting point of the codestrip that is used to determine the position of the carriage whilst in the print zone.

In a further alternative embodiment, the controller is arranged to read both codestrips at the same time, when this is possible. In this alternative embodiment the position of the carriage whilst in the print zone may be determined from a single codestrip as described above. However, as the carriage passes out of the print zone and into an acceleration/deceleration zone, the position of the carriage may be determined in that acceleration/deceleration zone relative to the distal or stanchion supported end of the codestrip being read at that time.

Second Embodiment

The second embodiment of the present invention generally employs the same apparatus and generally operates in the same manner as described with reference to the first embodiment. Therefore, similar apparatus and methods of operation will not be described further. Additionally, similar components are illustrated and numbered in the same manner as is the case in the earlier embodiment.

Generally, the carriage support and guide subsystems of scanning printers are prone to manufacturing imperfections.

One common such imperfection is a lack of straightness in the scan axis. Thus, in existing printers of this type, the carriage has a tendency to make small rotations about a given axis as it traverses the scan axis; for example its vertical axis, which is often known as the "Z" axis. This has the effect of causing the actual position of the printheads across the scan axis to differ from their positions measured relative to a codestrip. This is caused by the fact that due to the space constraints in the print zone, it is usually necessary to locate the codestrip offset from the printheads in the media feed direction. This effect often causes undesirable drop placement errors in prior art devices.

In the second embodiment, whilst the carriage is traversing the print zone, the controller simultaneously reads both codestrip 20*a* and codestrip 20*b*; giving rise to the output of two separate carriage position signals, one generated from each codestrip. By so doing, the actual position of the printheads along the scan axis may be more accurately determined, as is described below. As was the case in the first embodiment, however, the use of two codestrips, offset in the scan axis direction is retained. Therefore, in the second embodiment, in those portions of the scan axis where there is only one codestrip (i.e. across at least the majority of both of the acceleration/deceleration zones) only one of the codestrips is read by the controller to determine the position and speed of the carriage, as has been described above. It will be apparent that in such portions of the scan axis, the position of the printheads along the scan axis may not be determined more accurately than was the case in the first embodiment However, since the printer in not printing in these portions of the scan axis, such accurate position determination may not be required in these portions of the scan axis.

Figure 2B:
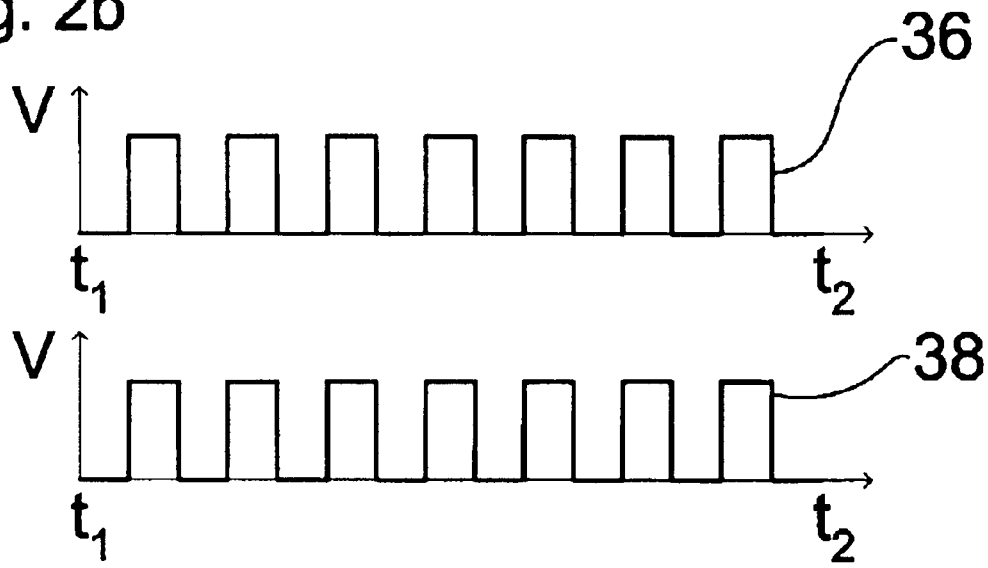
FIGS. 2*b* and 2*c* each schematically illustrate dual carriage position signals generated in one embodiment of the invention; and, FIGS. 3*a* and 3*b* schematically illustrate exemplary paths that the scanning ink-jet printer carriage of one embodiment of the invention may follow in traversing the print zone.
Figure 3A:
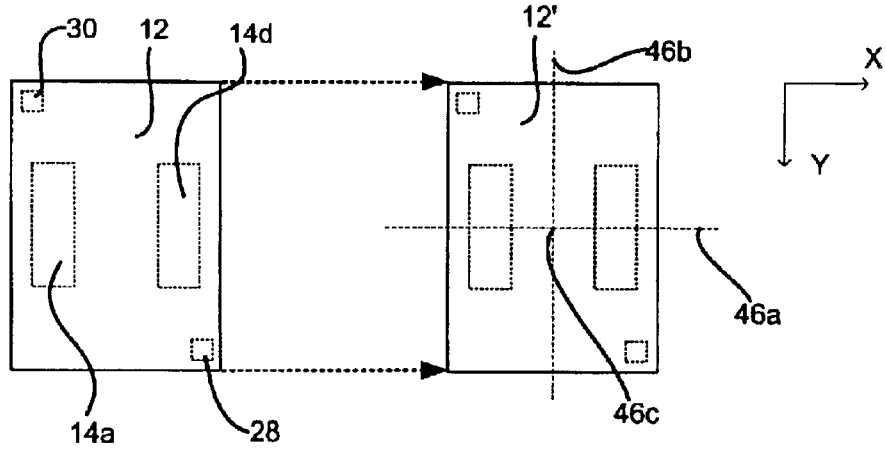

When the carriage is driven across the print zone without rotating about its Z axis, the frequency of the two carriage position signals output by the sensors 28*b* and 30*b*, that is to say high and low output values, will be the exactly or approximately the same. This situation is illustrated in FIG. 3*a* and FIG. 2*b*. In FIG. 3*a*, the position of the carriage 12 is shown at two instants in time, $t_1$ and $t_2$. At $t_1$, the carriage is labelled 12 and at $t_2$, the carriage is labelled 12'. For the sake of clarity, only the carriage body 12, the printheads 14*a* and 14*d*, and the two sensors 28 and 30 are shown. As can be seen from the figure, between $t_1$ and $t_2$ the carriage 12 has translated along the scan axis, in the direction of the arrows, without rotating in the Z axis. FIG. 2*b* illustrates exemplary carriage position signals 36 and 38 output by the sensors 28 and 30 respectively, between $t_1$ and $t_2$. As can be seen from the figure, the frequencies of the two carriage position signals 36 and 38 match. This indicates that the two sensors 30 and 28 progressed along their respective codestrips at the same speed between and to and $t_2$. In practice, there may or may not be a phase difference between the signals 36 and 38.

Where imperfections in the scan axis cause the carriage to rotate about the Z axis as it traverses the print zone, generally in an oscillating manner, one of the two sensors 28 and 30 may travel momentarily faster along its respective codestrip than the other; thus travelling further in a given time. Thus, during that given time it may output a carriage position signal at a higher frequency than the other.

When the carriage rotates back in the reverse direction, the opposite may be true.

Figure 2C:
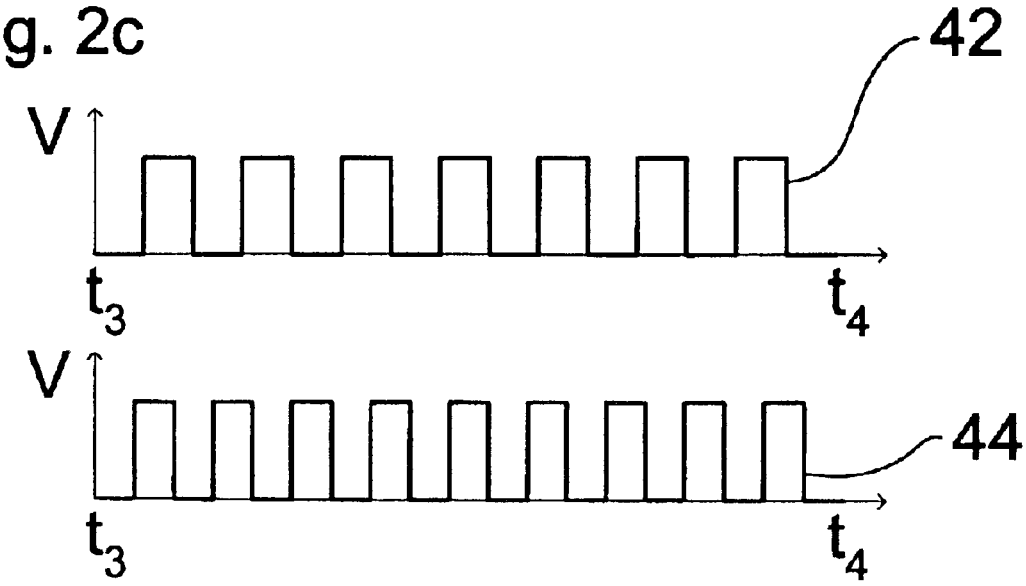
Figure 3B:
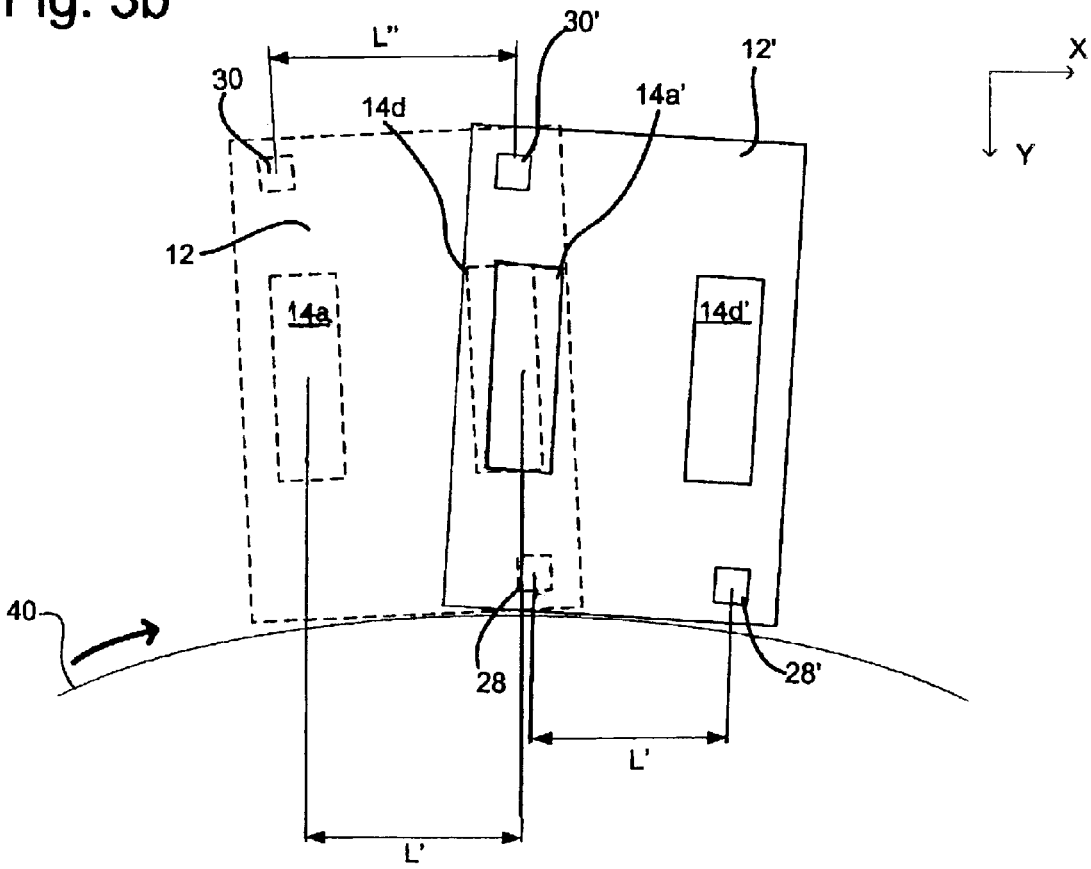

This process is illustrated in FIG. 3*b* and FIG. 2*c*. FIG. 3*b* illustrates, in a highly exaggerated manner, a curved path followed by the carriage 12 in part of the scan axis over the print zone, which causes the rotation of the carriage. The curved path is illustrated by the curved line 40, and direction of movement of the carriage along the path 40 (from left to right as viewed in the figure) is indicated by the arrow. Like FIG. 3*a*, FIG. 3*b* illustrates the position of the carriage 12 at two instants in time, $t_3$ and $t_4$. The carriage 12 and printheads 14*a* and 14*d* are shown with primed references, i.e. 12', 14*a*' and 14*d*', at $t_4$, and with unprimed references, i.e. 12, 14*a* and 14*d*, at t. For the purposes of clarity, the views of the carriage 12 are enlarged in FIG. 3*a* relative to FIG. 2*a*. Also for the sake of clarity, the carriage body 12, the printheads 14*a* and 14*d*, and the two sensors 30 and 28 are shown in dotted line at $t_3$ and in full line at $t_4$.

As can be seen from FIG. 3*b*, the location along the scan axis of the printhead 14*d* at $t_3$ is approximately the same that of the printhead 14*a*' is at $t_4$. However, due to the rotation of the carriage, the position of the printhead 14*a*' at $t_4$ does not exactly overlie the position of the printhead 14*d* at $t_3$. In this example, the sensor 30 travels further during this period than does the sensor 28. The distances travelled by the sensors 30 and 28 in this period are referenced in the figure L" and L, respectively. Thus, the frequency of the carriage position signal output by sensor 30 during this period is greater than that output by sensor 28. This is illustrated in FIG. 2*c*, which illustrates exemplary carriage position signals 42 and 44 output by the sensors 28 and 30 respectively, between $t_3$ and $t_4$.

The distance travelled by the printheads, for example printhead 14*a*, in the same time period is referenced in the figure L'. It will be appreciated that L' is greater than L and less than L", since the printheads lie at an intermediate distance from the centre of rotation of the printer carriage in relation to the two sensors 28 and 30. The distance L' actually corresponds to the distance travelled by the centre, in the Y axis, of the printhead 14*a*. It will in fact be appreciated that different areas of each printhead may travel different distances relative to each other when the carriage rotates about its Z axis. However, these differences may in practice be small in comparison to the differences between the distances travelled between either of the sensors 28, 30 and any part of the printhead. This is because a sensor such as 28 or 30 will generally be offset from the printheads in the Y direction by a relatively large distance; for example 160 millimetres. It will be noted that the figures, such as FIG. 3*b* are not drawn to scale.

During a given pass by the carriage over the print zone, the controller counts the pulses (or changes in state between high and low) for each of the carriage position signals output by the two sensors 28 and 30. This yields two cumulative totals. One of these, $T_2$ corresponds to the cumulative pulse total outputted during that pass by the sensor 30 and so corresponds to the distance along the codestrip 20*a* (i.e. from the left hand extreme end of the scan axis) that the sensor 30 has travelled in the first direction. The other, $T_1$ corresponds to the cumulative pulse total outputted during that pass by the sensor 28. However this total is added to a predetermined offset number, which corresponds to the distance in the X axis by which the codestrip 20*b* is separated from the side plate 18*a*. In this manner, when the sensor 28 starts to read the codestrip 20*b*, when travelling in the first direction, its position relative to the left hand extreme end of the scan axis is also known.

Either of the cumulative totals $T_1$ or $T_2$ would thus enable a conventional scanning inkjet printer controller to determine the position and velocity of the associated sensor 28 or 30 relative to the left hand extreme end of the scan axis using a conventional process. In the present embodiment of the invention, however, the controller repeatedly averages totals $T_1$ or $T_2$, to yield a composite total $T_3$. The composite total $T_3$ is then used as a "virtual carriage position signal".

The composite total $T_3$ may be generated in a number of ways. However in the present embodiment, each of the signals $T_1$ or $T_2$ is sampled at a rate significantly higher than the change rate of those signals. Whenever, either of the signals $T_1$ or $T_2$ is determined to have changed state, the current binary totals of the two signals are summed. The binary summed value is then divided by two. When the divided value yields a whole number, but not when the divided value yields a fraction, the composite total $T_3$ is updated to equal the divided value. In this way, the positional resolution of the virtual carriage position signal may be made to equal the carriage position signals output by the two sensors 28 and 30.

This virtual carriage position signal is used to determine the velocity and position along the scan axis of a point 46*c* located on the carriage 12; which is illustrated on carriage 12' in FIG. 3*a*. The determination of velocity and position of point 46*c* may, using the composite total $T_3$, then be made in using a conventional process, as mentioned above.

By carrying out a simple averaging of the totals $T_1$ and $T_2$, to generate the total $T_3$, it will be understood that the point 46*c* will be located midway between the two sensors 28 and 30 in both the X and Y axes.

In the present embodiment, the printheads 14*a–d* are located side by side in the carriage 12 and arranged so as to be collectively symmetrical about both an X and a Y axis in the carriage. These axes are respectively referenced 46*a* and 46*b* in FIG. 3*a*. Furthermore, in the present embodiment the position of the two sensors 28 and 30 and the printheads 14*a–d* are selected such that the midpoint 46*c* coincides with the point of intersection of the X and Y carriage axes. Thus, it will be appreciated that virtual carriage position signal may be used to determine the velocity and position of the central point in the X-Y plane of the four printheads 14*a–d*. In other embodiments, any suitable location relative to the carriage or printheads may instead by selected.

The virtual carriage position signal may then be used to drive the firing timing of the printheads. In this manner, any inaccuracy in drop placement caused as a result of the carriage rotating about its Z axis may be reduced since, in the present embodiment this position error is not magnified by the distance between the codestrip and sensor combination and the printheads. Furthermore, in the present embodiment, this may be done without the need for locating a codestrip and sensor in the crowded central part of the carriage.

In the present embodiment, the locations of either end of each codestrip in the scan axis may be measured in any conventional manner. This data may be stored in the printer operating system such that the controller is able to relate a position along the scan axis read from one codestrip with that read from the other codestrip; i.e. the controller may relate the position along the scan axis of given graduation of one codestrip to a corresponding graduation of the other codestrip. Preferably, the printer system is set up to so that a line printed perpendicular to the scan axis that is greater than the swath width of the pens should appear to be "continuous" and without jaggedness. That is to say that the abutting ends of portions of the line printed before and after media feed operations are not displaced from one another in the scan axis direction. By varying the relationship, or correspondence between the graduations of the two codestrips, such lines may be printed with varying degrees of jaggedness. In this way, various such lines that form a test pattern, may be printed with each line being printed using a different correspondence between the graduations of the two codestrips. A user may simply select the line that appears most continuous in order that the printer system can set the correspondence between the graduations of the two codestrips.

Further Embodiments

In the above description numerous specific details are set forth in order to provide a thorough understanding of the present invention. It will be apparent however, to one skilled in the art, that the present invention may be practiced without limitation to these specific details. In other instances, well known methods and structures have not been described in detail so as not to unnecessarily obscure the present invention.

For example, the skilled reader will appreciate that although the above embodiments were described with reference to a wide format inkjet printer, it may also be applied to a wide range of scanning devices where position information is derived from a codestrip; such as copiers, scanners, and non-inkjet scanning printers.

In the second embodiment, a single virtual carriage position located equidistant from the two sensors in the Y axis is generated using a simple average of the readings derived from the two codestrips. However, in other embodiments of the invention, a weighted average of the readings derived from the two codestrips may be generated and used as a virtual carriage position signal. In this manner, the position of a point (associated with the printheads for example) may be derived, where that point is not equidistant from the two sensors in the Y axis but weighted closer to one of the sensors than the other. This may be used to allow greater flexibility in the design of the printer, in terms of the placement of the codestrips relative to the print zone.

In further embodiments of the invention, more than one virtual position signal may be generated from the two codestrips. These may each have a different weighting of the two signals generated from the two codestrips. Unlike single codestrip systems, this gives rise to the advantage of being able to determine the position along the scan axis of two or more points or areas of the carriage or printhead(s) at the same time. In the case where large printheads are used this may be especially beneficial since even a small rotation of large printhead may cause appreciably different drop placement positions between nozzles in different positions in the printhead(s); and thus appreciable drop placement errors. In this manner, according to such embodiments the firing of different groups of nozzles or indeed individual nozzles may be independently controlled in dependence upon their detected positions.

Such techniques are more fully described in co-pending U.S. patent application, Ser. No. 10/424,830 filed on Apr. 29, 2003, titled "POSITION MEASUREMENT SYSTEM AND METHOD," which is hereby incorporated in its entirety into the present specification.

As was described above, codestrip sensors generally output two signals; a first or "A" signal and a second or "B" signal, which is 90 degrees out of phase with but otherwise similar to the "A" signal. The presence of the second signal allows the printer controller to determine changes in the direction of travel of the carriage. In certain prior art applications, the "A" and "B" signals of the standard optical sensors are XORed together. This effectively doubles the output resolution of the sensor to 600 dpi. It will be apparent to the skilled reader that this technique may be employed with benefit in embodiments of the present invention.

In the above-described embodiments, the codestrip sensors are offset from one another in the carriage in the direction of the scan axis. This means that in either direction of travel across the scan axis, one sensor is arranged to trail or follow the printheads. This in turn allows the proportion of the codestrips that is used to span the print zone to be increased and thereby allows the print zone width to be increased for a given codestrip length. However, it will be appreciated that alternative arrangement are possible in other embodiments. For example, the sensors arranged to read each codestrip could each be located at the same position in the X axis in the carriage.

Although two guide rods are used in the above-described embodiments, the skilled reader will appreciate that this need not be the case in other embodiments of the invention. The presence of two guide rods may be of assistance in embodiments where extra strength, rigidity or precision is required in the scan axis. For example, where the scanning carriage is comparatively massive and/or large. It will thus be appreciated that other embodiments of the present invention use only one guide rod or other scan axis structure. Furthermore, in other embodiments of the invention, three or more guide rods or other scan axis structure could be employed.

Although in the above described embodiments the sensors used are optical sensors, the skilled reader will appreciate that in practice any suitable sensor, such as magnetic sensors, may instead be used.

What is claimed is:

1. A hardcopy device having a scanning head arranged to reciprocate across a scan axis, and first and second codestrips arranged substantially parallel to the scan axis, the first and second codestrips being offset from one another in the scan axis, such that the device may determine the position of the head along the scan axis relative to the first and second codestrips in a first set of positions but relative to only one of the first and second codestrips in a second set of positions.

2. A device according to claim 1, wherein the first set of position corresponds to a print zone or a scanning area.

3. A device according to claim 2, wherein the first and/or the second zone corresponds to an acceleration/deceleration zone or a printhead servicing zone.

4. A device according to claim 1, wherein the device is adopted to derive position information substantially simultaneously both the first and the second codestrip when the head is in the first set of positions.

5. A device according to claim 4, further arranged to compensate for position measurement errors of the head in the scan axis due to rotation of the head about a second axis.

6. A device according to claim 4, further arranged to generate a simple average or a weighted average of the position information read from the first and second codestrips.

7. A device according to claim 6, wherein the device is an inkjet printer.

8. A device according to claim 7, wherein the device is further arranged to control the timing of the firing of a plurality of ink ejection nozzles in dependence upon the compensated head position.

9. A device according to claim 4, further arranged to compensate for position measurement errors by interpolating or extrapolating from the position information derived from the first and second codestrips, where the first and second codestrips are mutually spaced apart in third axis and the scan axis and the second and third axes being mutually orthogonal.

10. A device according to claim 9, wherein second axis is the vertical axis.

11. A device according to claim 9, wherein the device is an inkjet printer.

12. A device according to claim 11, wherein the device is further arranged to control the timing of the firing of a plurality of ink ejection nozzles in dependence upon the compensated head position.

13. A device according to claim 12, further arranged to determine the position along the scan axis of a plurality of locations associated with the head from a corresponding plurality of differently weighted averages of the position information derived from the first and second codestrips.

14. A device according to claim 13, wherein the device is further arranged to control independently the timing of the firing of a plurality of groups or ink ejection nozzles in dependence upon the determined positions.

15. A device according to claim 14, wherein one of the plurality of groups of ink ejection nozzles comprise one or more primitives.

16. A device according to claim 14, wherein one of the plurality of groups of ink ejection nozzles comprises a fraction of a primitive.

17. A device according to claim 16, wherein one of the plurality of groups of ink election nozzles comprises an individual nozzle.

18. A hardcopy device having a print zone and a carriage arranged to reciprocate across a scan axis traversing the print zone and first and second zones located adjacent to and on opposing sides of the print zone, the device being arranged to determine the position of the carriage along the scan axis from first and second codestrips arranged substantially parallel to the scan axis, the first codestrip spanning the print zone and the first zone, the second codestrip spanning the print zone and the second zone, such that the codestrips overlap along the scan axis substantially only across the print zone.

19. A method for determining the position of a scanning along a scan axis in a hardcopy device, the device having first and second codestrips arranged substantially parallel to the scan axis and offset from one another in the scan axis, comprising the steps of:

simultaneously, generating position information from the first and second codestrips in a first set of positions along the scan axis where the first and second codestrips overlap;

generating position information from only one of the first or second codestrips in a second set of positions along the scan axis where the first and second codestrips do not overlap.

20. A method according to claim 19, further comprising the step of generating a simple or a weighted average of the position information read from the first and second codestrips when the head is substantially in the first set of positions.

21. A computer program comprising program code means for performing the method steps of claim 19 when the program is ran on a computer and/or other processing means associated with suitable apparatus.

22. A processor device for performing the method steps of claim 19 when associated with suitable apparatus.

* * * * *

UNITED STATES PATENT AND TRADEMARK OFFICE

CERTIFICATE OF CORRECTION

PATENT NO. : 6,851,789 B2
APPLICATION NO. : 10/424809
DATED : February 8, 2005
INVENTOR(S) : Emilio Cano et al.

It is certified that error appears in the above-identified patent and that said Letters Patent is hereby corrected as shown below:

In column 4, line 36, delete "dose" and insert -- close --, therefor.

In column 7, line 20, after "an" delete "is".

In column 9, line 52, after "and" delete "to" and insert -- $t_1$ --, therefor.

In column 10, line 7, delete "at t" and insert -- at $t_3$ --, therefor.

In column 13, line 40, in Claim 4, delete "adopted" and insert -- adapted --, therefor.

In column 14, line 15, in Claim 14, delete "or" and insert -- of --, therefor.

In column 14, line 24, in Claim 17, delete "election" and insert -- ejection --, therefor.

In column 14, line 57, in Claim 21, delete "ran" and insert -- run --, therefor.

Signed and Sealed this

Third Day of November, 2009

David J. Kappos

David J. Kappos
*Director of the United States Patent and Trademark Office*